US009574468B2

(12) United States Patent
Boutell

(10) Patent No.: US 9,574,468 B2
(45) Date of Patent: Feb. 21, 2017

(54) VARIABLE VALVE OPERATION CONTROL METHOD AND APPARATUS

(71) Applicant: Toyota Motor Engineering & Manufacturing North America, Inc., Erlanger, KY (US)

(72) Inventor: Dante T. Boutell, Manhattan Beach, CA (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 356 days.

(21) Appl. No.: 13/653,778

(22) Filed: Oct. 17, 2012

(65) Prior Publication Data

US 2014/0102385 A1 Apr. 17, 2014

(51) Int. Cl.
*F01L 1/34* (2006.01)
*F01L 13/00* (2006.01)

(52) U.S. Cl.
CPC .... *F01L 13/0063* (2013.01); *F01L 2013/0073* (2013.01); *F01L 2013/113* (2013.01); *F01L 2105/00* (2013.01); *F01L 2250/00* (2013.01); *F01L 2820/032* (2013.01)

(58) Field of Classification Search
CPC ..... F01L 13/0063; F01L 2013/113; F01L 2250/00
USPC ..... 123/90.16, 90.15, 90.17
See application file for complete search history.

(56) References Cited

U.S. PATENT DOCUMENTS

| | | | | |
|---|---|---|---|---|
| 4,062,332 | A | 12/1977 | Perr | |
| 4,664,070 | A * | 5/1987 | Meistrick et al. | 123/21 |
| 5,284,116 | A | 2/1994 | Richeson, Jr. | |
| 5,752,478 | A * | 5/1998 | Sono et al. | 123/90.11 |
| 6,092,495 | A * | 7/2000 | Hackett | 123/90.15 |
| 6,138,627 | A | 10/2000 | Iida | |
| 6,230,675 | B1 * | 5/2001 | Kobayashi et al. | 123/90.15 |
| 6,295,957 | B1 | 10/2001 | Cobb, Jr. | |
| 6,470,851 | B1 * | 10/2002 | DeGroot et al. | 123/323 |
| 6,810,850 | B2 | 11/2004 | Anderson et al. | |
| 6,889,674 | B2 | 5/2005 | Pateman et al. | |
| 6,925,976 | B2 | 8/2005 | Israel et al. | |
| 6,948,468 | B1 | 9/2005 | Decuir, Jr. | |
| 7,077,088 | B1 | 7/2006 | Decuir, Jr. | |
| 7,299,775 | B2 | 11/2007 | Tateno et al. | |
| 8,033,261 | B1 | 10/2011 | Robbins | |
| 8,042,505 | B2 | 10/2011 | Eisenbeis | |
| 8,056,541 | B1 | 11/2011 | Nick | |
| 8,087,393 | B2 | 1/2012 | Cascia | |
| 2001/0050067 | A1 * | 12/2001 | Sato | 123/90.17 |
| 2002/0088416 | A1 * | 7/2002 | Nakamura et al. | 123/90.16 |
| 2005/0028768 | A1 * | 2/2005 | Ezaki et al. | 123/90.16 |

(Continued)

*Primary Examiner* — Ching Chang
(74) *Attorney, Agent, or Firm* — Christopher G. Darrow; Darrow Mustafa PC

(57) ABSTRACT

A control method and apparatus for a variable engine valve operating control mechanisms which move the engine valves to a safe lift/timing position with respect to a piston to minimize the potential for valve to piston contact during valve surge. At least one engine operating conditions is selected and provided with a threshold triggering a control to move the valves to a safe position in a calibrated, predictive manner in advance of any potential valve to piston contact. The control method and apparatus can be integrated into the existing engine control and variable valve operating control mechanism.

18 Claims, 9 Drawing Sheets

(56) References Cited

U.S. PATENT DOCUMENTS

| | | | | |
|---|---|---|---|---|
| 2005/0224046 | A1 | 10/2005 | Israel et al. | |
| 2005/0274343 | A1* | 12/2005 | Nakano | 123/90.16 |
| 2007/0095313 | A1* | 5/2007 | Kamiyama et al. | 123/90.16 |
| 2009/0266338 | A1* | 10/2009 | Kamiyama et al. | 123/48 C |
| 2010/0089348 | A1* | 4/2010 | Kidooka et al. | 123/90.16 |
| 2011/0180028 | A1* | 7/2011 | Takemura et al. | 123/90.16 |
| 2011/0277719 | A1 | 11/2011 | Snow | |

* cited by examiner

VARIABLE VALVE OPERATION CONTROL METHOD AND APPARATUS

BACKGROUND

The present description relates, in general, to internal combustion engines and, more particularly, internal combustion engines having variable valve operating characteristics.

Internal combustion engines use a timed coordination between intake and exhaust valves and a reciprocating piston within each cylinder to control the flow of intake charge into the cylinder and the flow of combustion exhaust gases from the cylinder.

In the past, the amount of movement of the intake and exhaust valves with respect to the intake and exhaust combustion chamber ports was fixed. Recent engine developments have allowed for variable valve characteristics in response to varying engine load, speed and other operating conditions.

Generally, the variable valve operating mechanism changes the lift, timing or operating angle of the valve. For example, such a mechanism can allow valve actuation from a low lift state at low engine speed or loads to a higher lift for greater valve stroke distance into the engine cylinder and a greater port opening at higher operating speeds and/or loads to allow for increased intake charge flow into the cylinder and to achieve increased engine efficiency.

However, in a high valve lift mode of operation, the clearance between the valve and the piston decreases. During an engine over-rev, which can be caused by miss-shifting, this causes valve surge in which the valves cannot strictly follow the cam profile, particularly during valve closing. Generally speaking, valve surge or float occurs when the valve springs does not have sufficient force to follow a valve closing cam profile. The resulting contact between the valve and the piston can cause catastrophic engine failure.

It would be desirable to provide a variable valve operating control method and apparatus which minimizes the possibility of valve to piston contact.

SUMMARY

An internal combustion engine valve operation control apparatus for at least one of an intake valve and an exhaust valve movably disposed with respect to an engine cylinder to open and close a port in the engine combustion chamber in a timed relationship to the position of a piston reciprocally mounted in the engine cylinder, includes an intake and an exhaust valve movement actuator coupled to the at least one of the intake valve and the exhaust valve to control movement of the at least one of the intake valve and the exhaust valve between engine combustion chamber port closed and port open positions in response to changes in engine operating parameters. A control receives engine operating parameter signals from the engine, and controls the valve movement actuator to move the at least one of the intake valve and the exhaust valve to a safe position with respect to the piston in the engine cylinder under predetermined engine operating conditions to prevent contact between the at least one of the intake valve and the exhaust valve and the piston.

The intake and exhaust valve movement actuator variably positions the at least one of the intake valve and the exhaust valve in one of a low lift position where the at least one of the intake valve and the exhaust valve extends a small distance into the cylinder at a valve open position at a first engine operation state and a high lift position where the at least one of the intake valve and the exhaust valve extends a greater distance into the cylinder during a second engine operating condition.

The control moves the intake and exhaust valve movement actuator to move the at least one of the intake valve and the exhaust valve to the safe position as the engine operating conditions move from the first state toward the second state.

The control is responsive to the rate of change of engine operating conditions moving from the first state toward the second state.

The control executes a stored program of engine operating conditions setting a threshold of one engine operating condition associated with contact of the at least one intake exhaust valve with the piston.

In one aspect, the engine operating condition is engine speed, and the threshold is a predetermined engine speed.

In another aspect, the engine operating condition is engine speed, and the threshold is a predetermined rate of increase in engine speed.

The calibratible engine speed is determined, for predetermined rate of increase in engine speed, that corresponds to a likelihood of contact between the at least one of the intake valve and the exhaust valve with the piston. The control, in response to the engine speed reaching the predetermined speed, controls the intake and exhaust valve movement actuator to move the at least one of the intake valve and the exhaust valve to the safe position.

In one aspect, the engine operating condition is a predetermined acceleration rate of the engine above an expected acceleration rate of engine operation.

In one aspect, the control moves the at least one of the intake valve and the exhaust valve to a safe position defined by movement of the valve from a high lift state toward a low lift state. In another aspect, the control, in response to engine operating conditions, moving the at least one of the intake valve and the exhaust valve to the safe position by varying the value timing or by reducing the preset valve open time duration.

A method of controlling the position of at least one of an intake valve and an exhaust valve in one combustion chamber of an internal combustion engine with respect to piston position in the combustion chamber based on engine operating conditions includes:

sensing at least one engine operating conditions;

comparing the current value of the at least one engine operating condition with prestored values of the at least one intake and exhaust valve position with respect to the position of the piston in the combustion chamber;

establishing a threshold value of the engine operating condition and the preset valve position above which an increase in the engine operating condition increases the possibility of contact between the at least one of the intake valve and exhaust valve with the piston; and when the threshold value is met, moving the at least one of the intake valve and the exhaust valve to a safe position to minimize potential contact with the piston.

The method also includes the step of establishing the threshold and the predetermined rate of change of engine operating conditions with respect to the one of the intake valve and the exhaust valve engine cycle positions.

In one aspect, the method sets the predetermined engine operating condition as engine speed.

Where the at least one of the intake valve and the exhaust valve moves between a low lift and a high lift position depending upon the engine operating condition, the method moves at least one of the intake valve and the exhaust valve from the high lift position toward the low lift position when the threshold is met.

BRIEF DESCRIPTION OF THE DRAWING

The various features, advantages and other uses of the present variable valve operating control method and apparatus will become more apparent by referring to the following detailed description and drawing in which.

DETAILED DESCRIPTION

Figure 1:
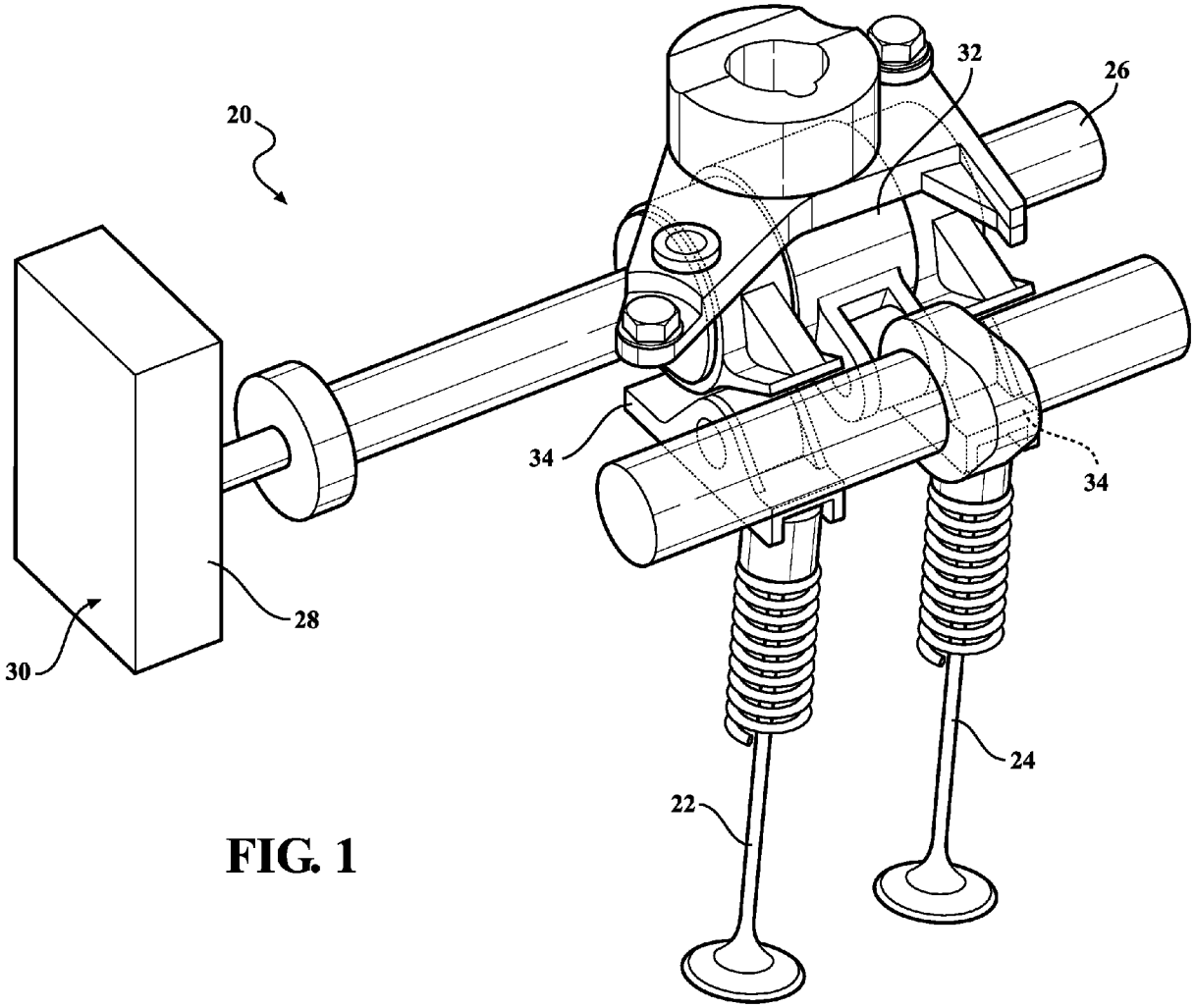
FIG. 1 is a perspective view of the variable valve operating apparatus showing the intake valves for a single engine cylinder of a multi-cylinder engine.
Figure 2:
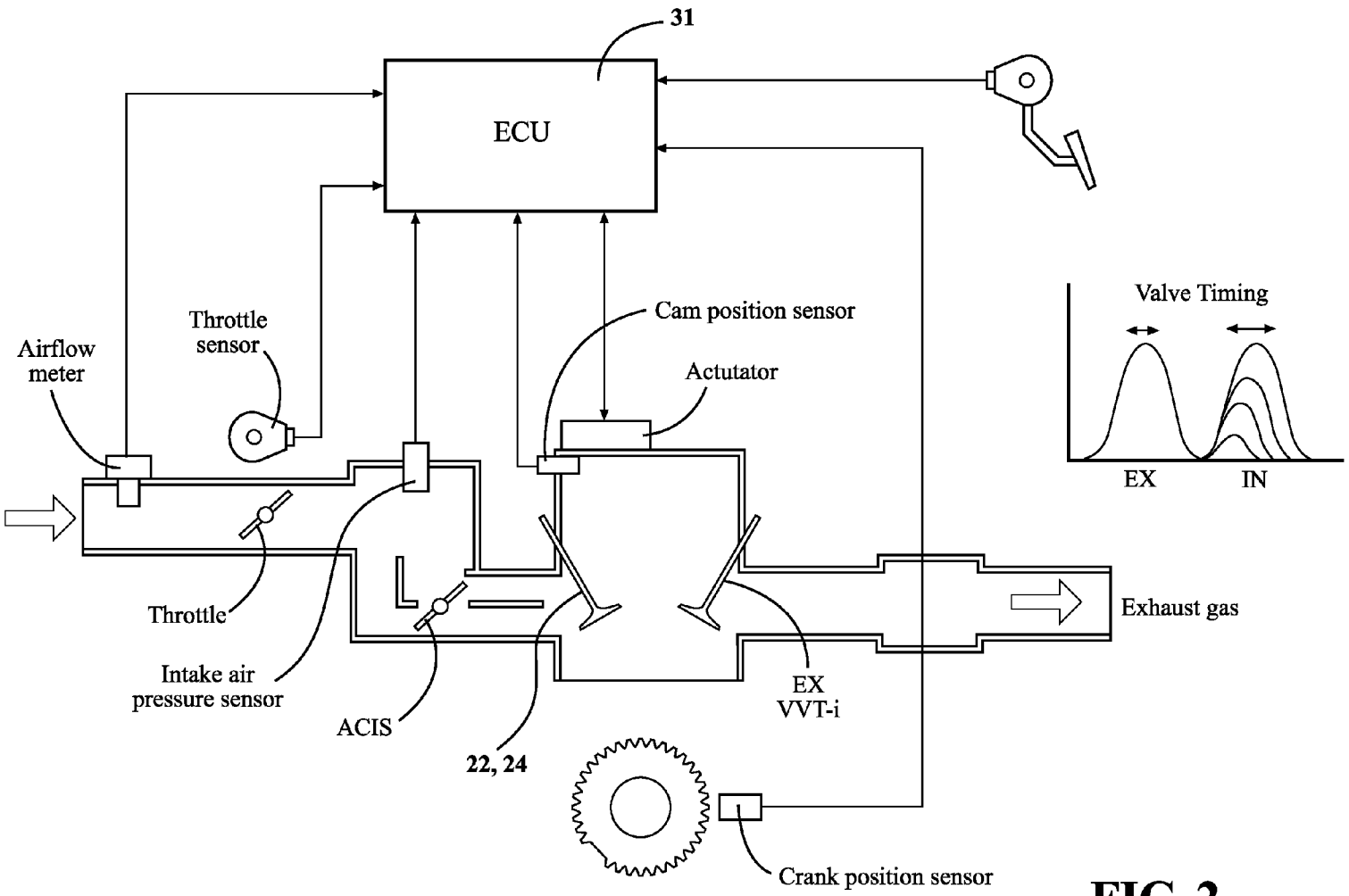
FIG. 2 is a schematic diagram of the variable valve operating control apparatus partially shown in FIG. 1.
Figure 3:
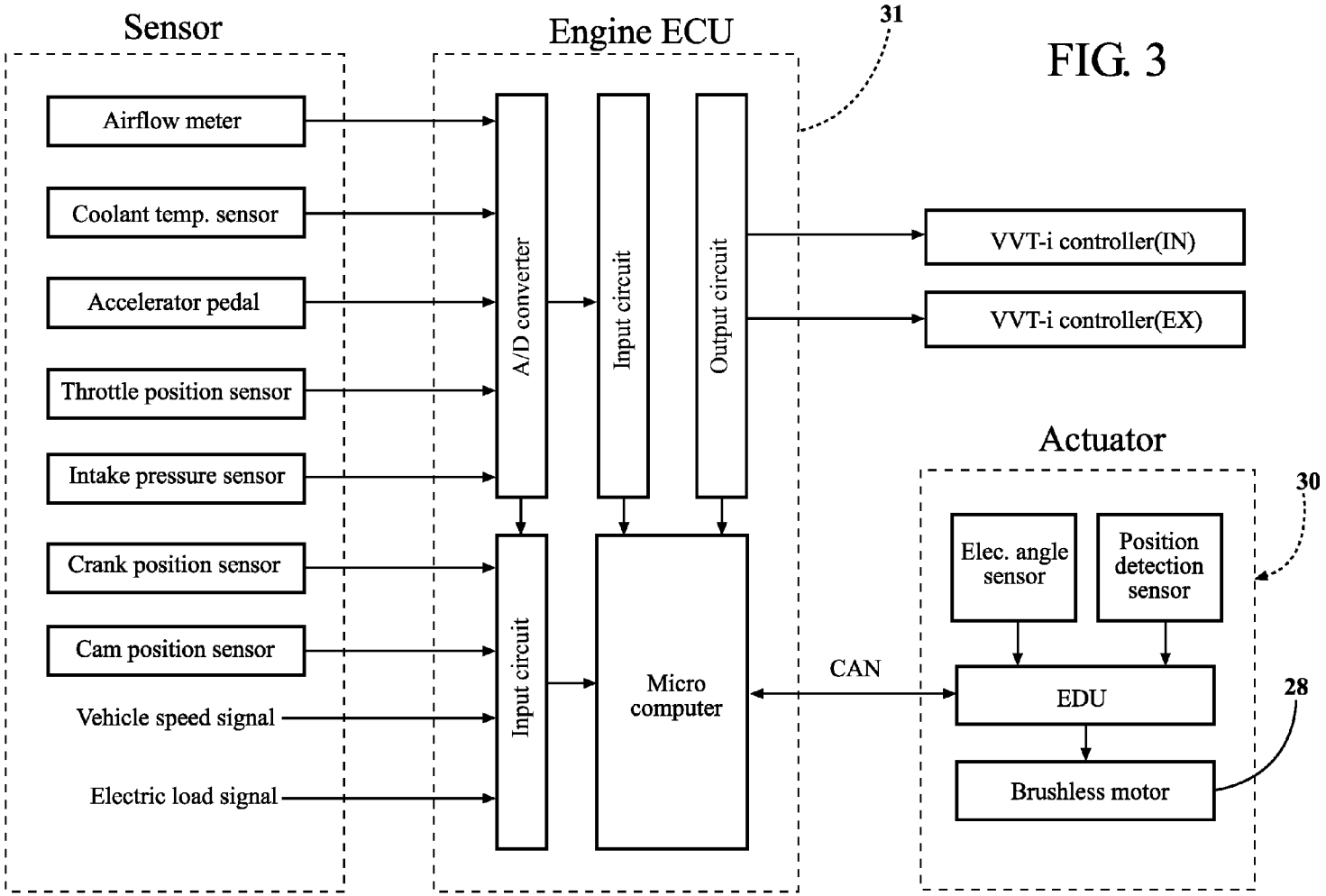
FIG. 3 is a block diagram of the variable valve operating control apparatus shown in FIGS. 1 and 2.

Referring now to the drawing, into FIGS. 1-7B in particular, there is depicted a variable valve operating control apparatus and method which minimizes the possibility of contact between an intake and/or an exhaust valve and a piston under certain engine operating conditions.

In the following description, the following terms have the meaning set forth herein and/or are calculated or measured as described below.

Engine Speed-calculated from crankshaft position sensor value.

Valve Angle-calculated from camshaft position sensor signal.

Engine Load-calculated from intake air amount measured by an airflow sensor.

Valve Operating Angle-the total crank angle of which a valve is opened (proportional to valve lift in some variable valve control mechanisms).

Valve Lift-the distance (in millimeters) that a valve moves between closed and fully opened positions.

Valve Timing-when a valve opens and/or closes, measured in degrees of crankshaft angular position (also referred to as crank angle).

Variable Valve Timing (VVT)-the control that varies valve timing with different engine operating conditions.

The present variable valve operating control method and apparatus may be used with any internal combustion engine which has variable valve operating characteristics controls which are capable of varying the valve operating characteristics under varying engine speed, load and operating conditions. The present variable valve operating control method and apparatus is usable with any internal combustion engine, regardless of the number of combustion chambers, the number of intake valves per combustion chamber, or the number of exhaust valves per combustion chamber.

It will be understood that, although the following description and drawings illustrate the present variable valve control method and apparatus in conjunction with a pair of intake valves associated with one engine combustion chamber, the method and apparatus are employable with the single intake valve or a single exhaust valve on a single engine combustion chamber, only on the intake valve or valves of each engine combustion chamber, only on the exhaust valve or valves of each engine combustion chamber, or on both of the intake and exhaust valve or valves on each combustion chamber of an engine.

FIG. 1 depicts one example of a variable valve operating control method and apparatus 20 which is capable of varying any one or more of an intake or exhaust valve operating characteristics during engine operation.

By way of example, FIG. 1 depicts a pair of intake valves 22 and 24 associated with one engine combustion chamber.

As explained in greater detail in U.S. Pat. No. 7,299,775, the contents of which are incorporated herein in its entirety, the variable valve control includes an intake and/or exhaust valve movement actuator in the form of a control shaft 26 driven by a motor 28 under the control of an actuator 30. The actuator 30, as described hereafter, is responsive to signals from the engine control unit (ECU) 31 which is in turn responsive to various engine operating parameters, such as engine speed, load, etc. It will be understood that the following description of the variable valve operating mechanism is by way of example only as any type of mechanism for varying an operating parameter of an intake and/or an exhaust valve of an internal combustion engine can employ the present control method and apparatus.

As explained in the above-identified patent, the actuator 30 is coupled to the motor 28 which controls the linear reciprocal movement of the control shaft 26. This changes the angles of interaction of the control shaft 26 with a roller arm 32, roller rocker 34 for each intake valve 22 or 24, and the cam shaft 36 (in FIGS. 4A and 4B) to thereby change the amount of lift or movement for opening or closing the intake valves 22 and 24.

Figure 4B:
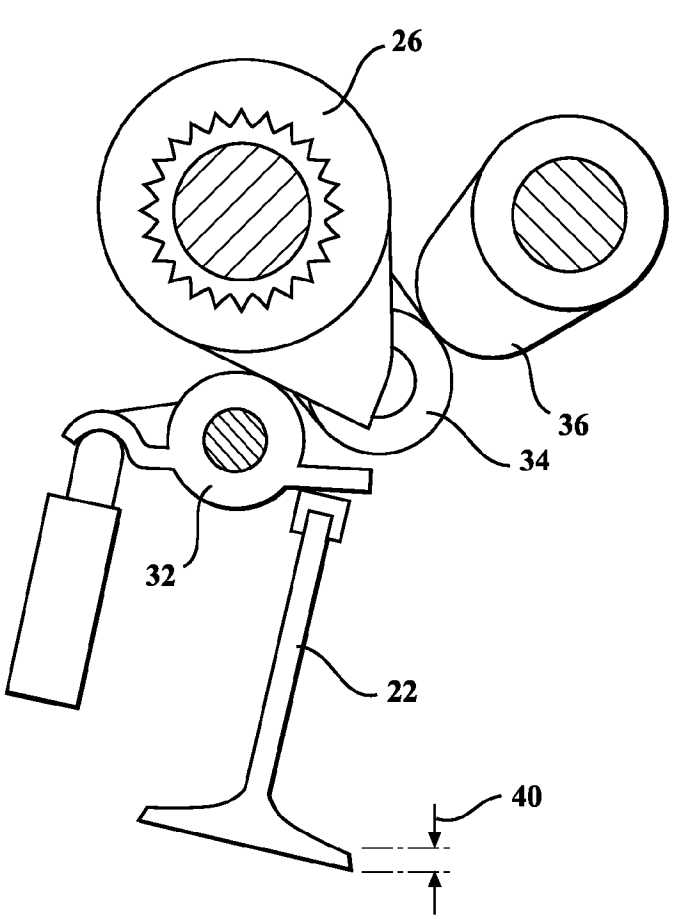
FIGS. 4A and 4B are pictorial representations of the variable valve control apparatus shown in FIG. 1 depicting the intake valve in closed and low lift open positions.
Figure 4A:
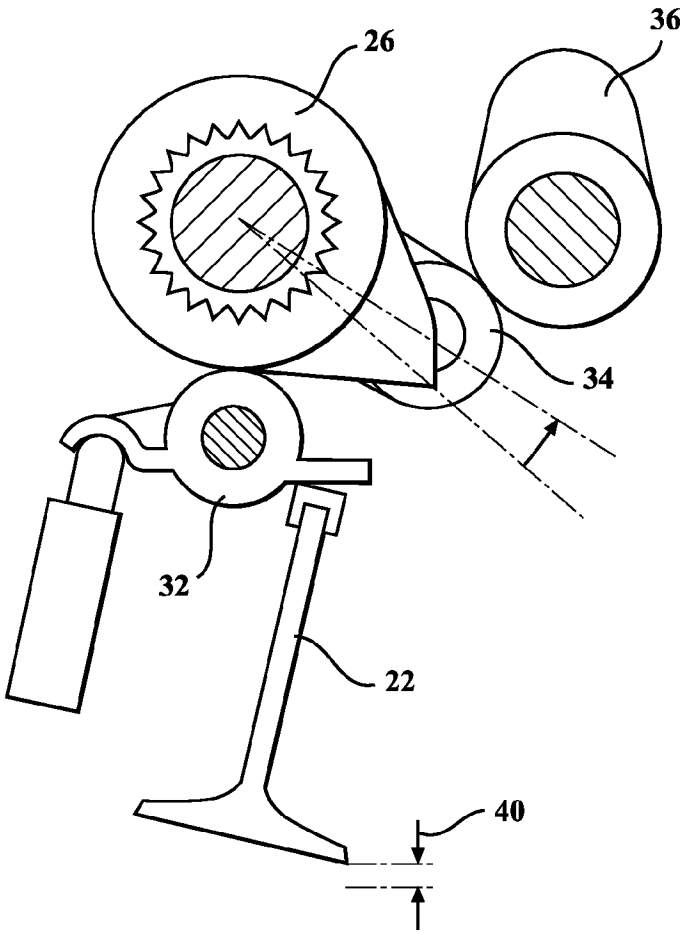
Figure 5A:
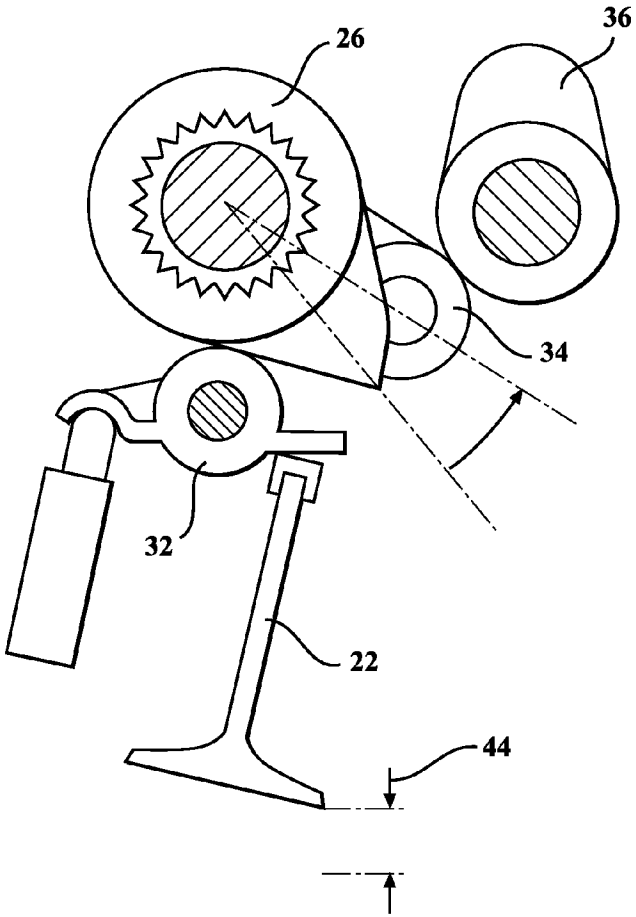
FIGS. 5A and 5B are pictorial representations of the variable valve control apparatus shown in FIG. 1 depicting the intake valve in closed and high lift open positions.
Figure 5B:
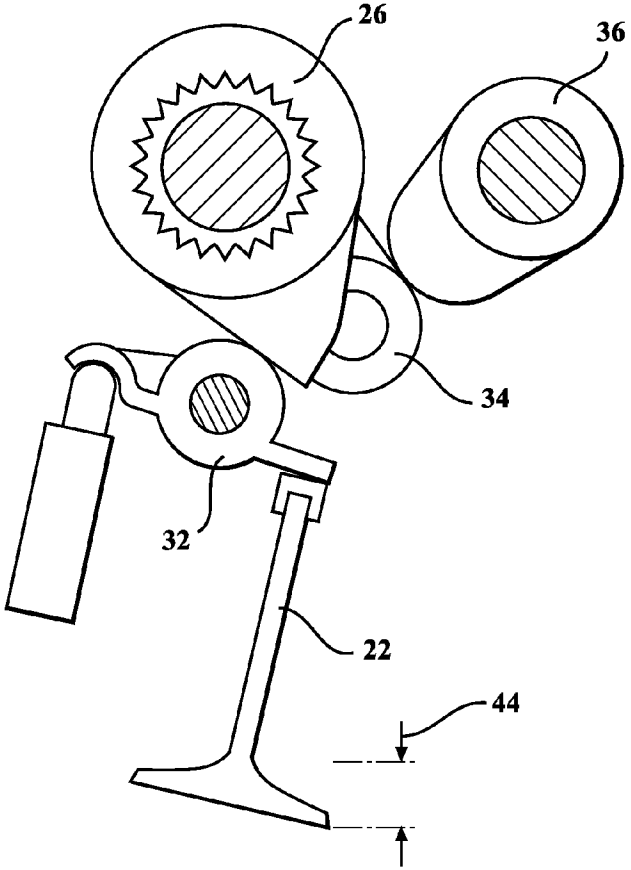

As shown in FIGS. 4A and 4B, at idle or low engine operating speeds, the control shaft 26 is positioned by the actuator 30 and the motor 28 so as to allow movement of the intake valve 22 from the fully closed position shown in FIG. 4A to the fully opened position shown in FIG. 4B with only a small amount of valve lift or opening movement as denoted by the low lift dimension 40. Similarly, and as described hereafter, at higher engine operating speeds and/or engine loads, the variable valve operating mechanism changes the interaction of the control shaft 26, the roller rocker 34, the roller arm 32 and the cam shaft 36 to create a greater distance of valve lift or movement between the fully closed valve position shown in FIG. 5A and the fully open position of the intake valve 22 for a so-called high lift position 44.

In order to prevent contact between the valve, such as one of the intake valves 22 and 24 and the top of the piston during high lift modes of operation of the intake valves 22 and 24, the present method and apparatus create a look-up table containing data stored in a memory accessed by the ECU 31 which represents one or more engine operating parameters to detect the approach of one or more engine operating parameters to detect the potential contact between an intake valve 22 and 24 and the piston.

Figure 6A:
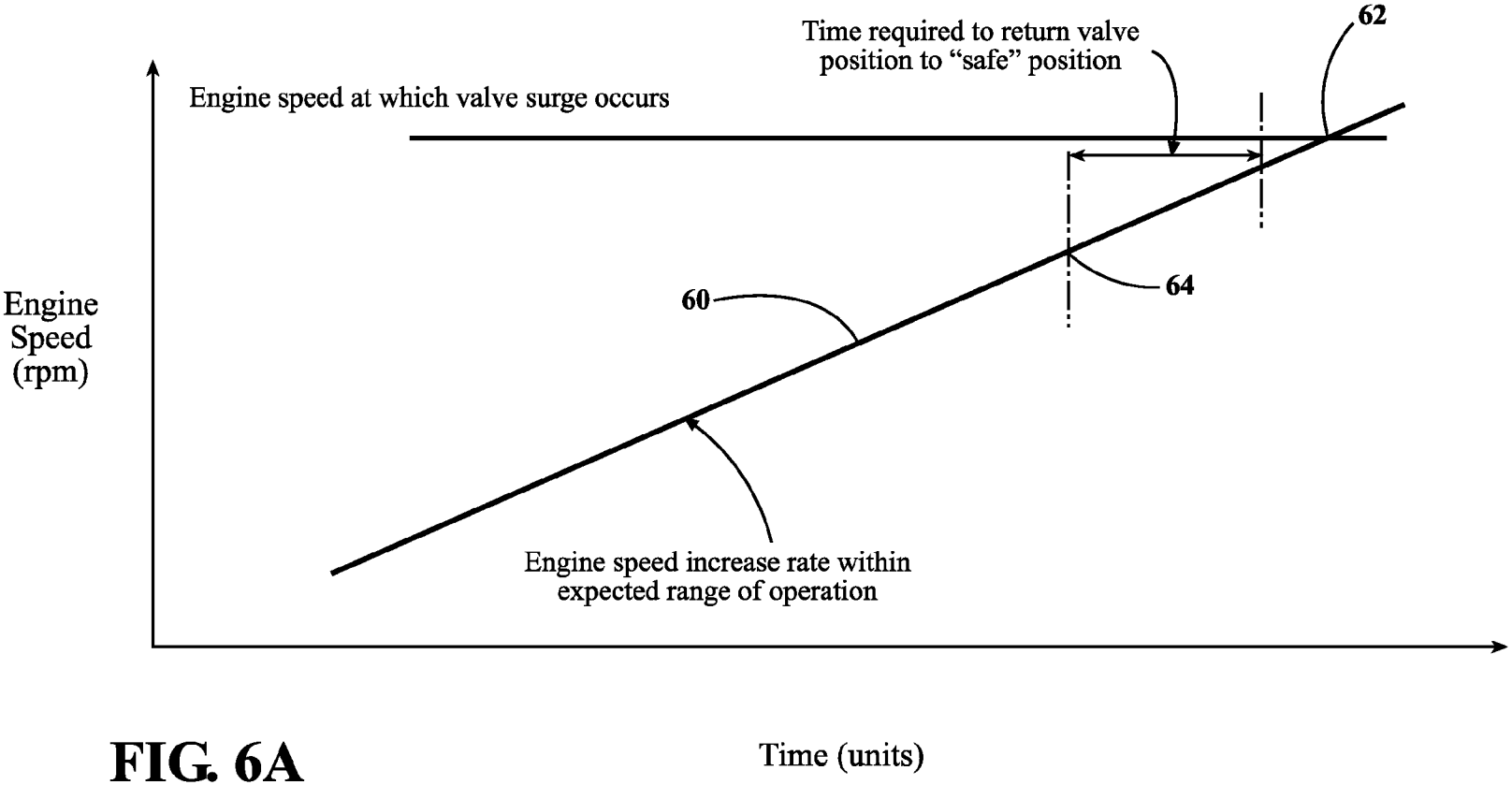
FIG. 6A is a graph depicting engine speed versus time where the engine speed increase rate is within an expected range of operation to show one aspect of a valve operating control method and apparatus.
Figure 7A:
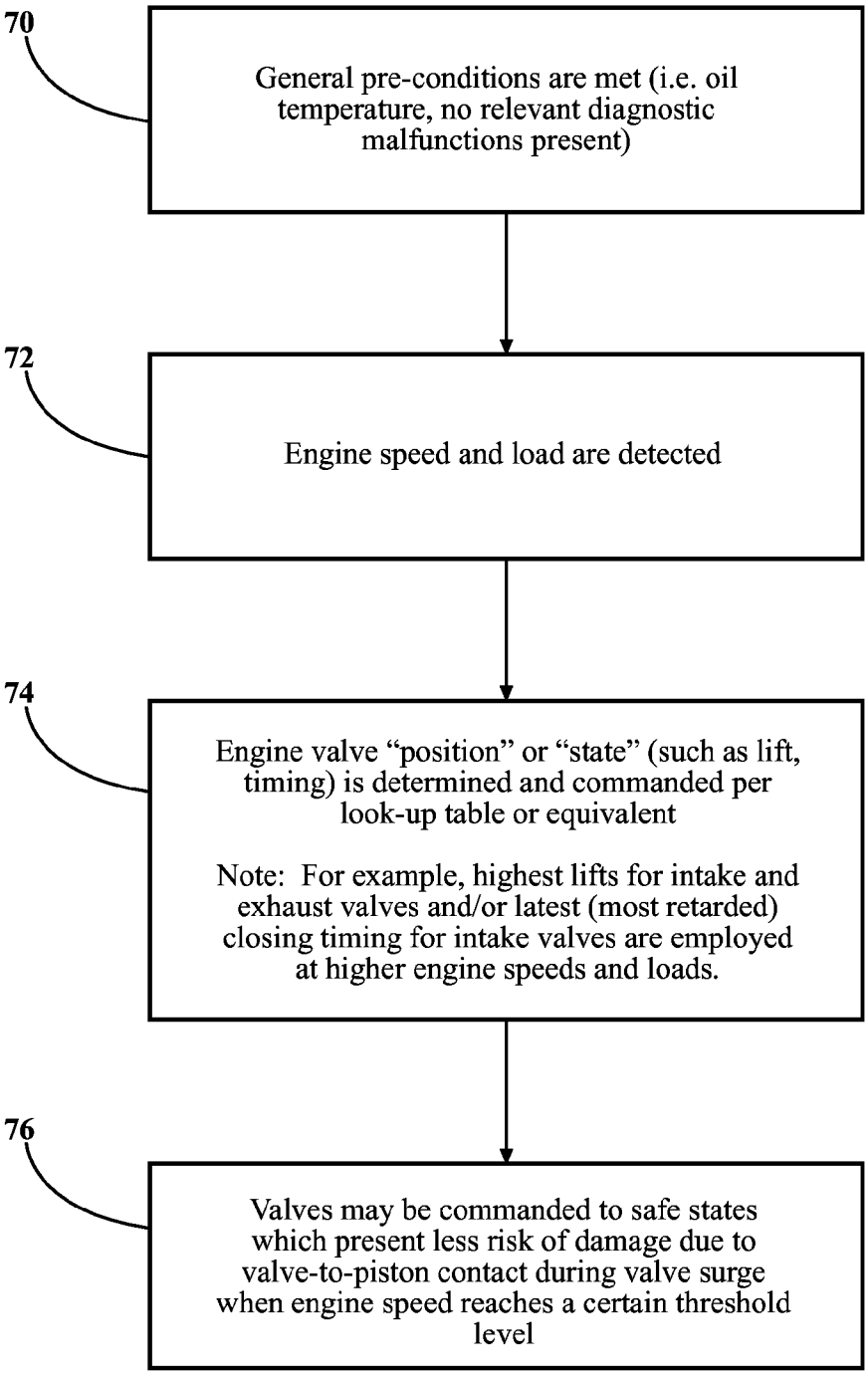
FIG. 7A is a flow chart depicting the sequence control steps for implementing the aspect of the valve operating control method and apparatus depicted in FIG. 6A.

One aspect of the operation of the apparatus performing the control method is shown in FIGS. 6A and 7A. FIG. 6A represents a graph of engine speed and RPMs over time where the engine speed is gradually increasing within an expected range of acceleration along line 60. An engine speed 62 is calculated at which valve surge is possible depending upon the design tolerances of a particular engine. This speed 62 is shown on the engine speed line 60 in the graph of FIG. 6A.

Generally, the present method and apparatus anticipate an engine speed where a valve surge is possible. At a predetermined engine speed prior to the engine speed 62, such as engine speed 64 on graph line 60, the ECU 31, taking into account the time required to return the valve position to a safe position, described hereafter, will send signals to the actuator 30 to move the control shaft 26 in a direction to return the valve, such as intake valves 22 and 24 associated with one combustion chamber of the engine, to a safe position. The safe position is determinable with respect to each engine and generally is a position where the amount of valve lift or the valve timing is such to minimize any possibility of contact between the intake valve 22 or 24 and the piston. The safe position can be, but does not necessarily have to be, the low lift or low valve open position shown in FIG. 4B. The safe position can also be any other position between the high lift position of the valve and the fully closed position of the valve. The safe position can be any position where contact between the intake valves 22 or 24 in the piston is minimal or non-existing.

The safe position can also be a variation in the valve timing such as a variation in the valve operating angle for a variation in valve timing due to a change in the valve opening and valve closing crank angle.

The ECU 31 takes into account the time it takes to return the valves 22 and 24 to the safe position. This can be a variable amount of time depending upon the amount of valve timing. Thus, the ECU 31 at engine speed 64 on graph line 60 will send signals to the actuator 30 to move the control shaft 26 in a direction to begin to return the intake valves 22 and 24 to the predetermined safe position. This can cause a variation of the valve timing so that the amount of valves open or time duration is immediately reduced, or the valve lift is varied to cause retraction of the valve towards the closed position.

As shown in FIG. 7A, the ECU 31 executes a control program which determines in step 70 that engine preconditions are met, with respect to engine operating parameters including oil temperature, lack of relevant diagnostic malfunctions present, etc. The engine speed and engine load are then detected in step 72. The ECU 31, in step 74, then determines the engine valve position or state, such as valve lift, valve timing or valve opening duration. Depending on the valve intake positions, the engine speed and the engine load, the ECU 31 in step 76 may command the intake valves 22 and 24 via adjustments in the linear position of the control shaft 26 to move to safe states or positions with respect to the piston to prevent less risk of damage due to valve to piston contact during valve surge after the engine speed reaches a predetermined or certain threshold level, such as denoted by engine speed 64 in FIG. 6A.

The graph line 60 in FIG. 6A depicts the calculated acceleration rate for an expected acceleration increase within normal range of operation of the engine. With appropriate tolerances, the graph line 60 can be stored in memory as a look-up table accessible by the ECU 31 when the engine is operating. If the engine speed increase rate or acceleration of the engine follows the graph line 60 or is below the graph line 60, the ECU 31 when the engine speed 64 on the graph line 60 is reached, will implement protective action to move the intake valves 22 and 24 to the safe position.

The movement of the safe position can constitute simply moving the intake valves 22 and 24 toward, but not fully to the closed position. Alternately, the ECU 31 can implement action to move the intake valves 22 and 24 to the safe position defined by altering, or decreasing the valve open duration time. This has the effect of moving the intake valves 22 and 24 toward the low lift or closed position prior to the programmed normal end of the valve open time duration.

Figure 6B:
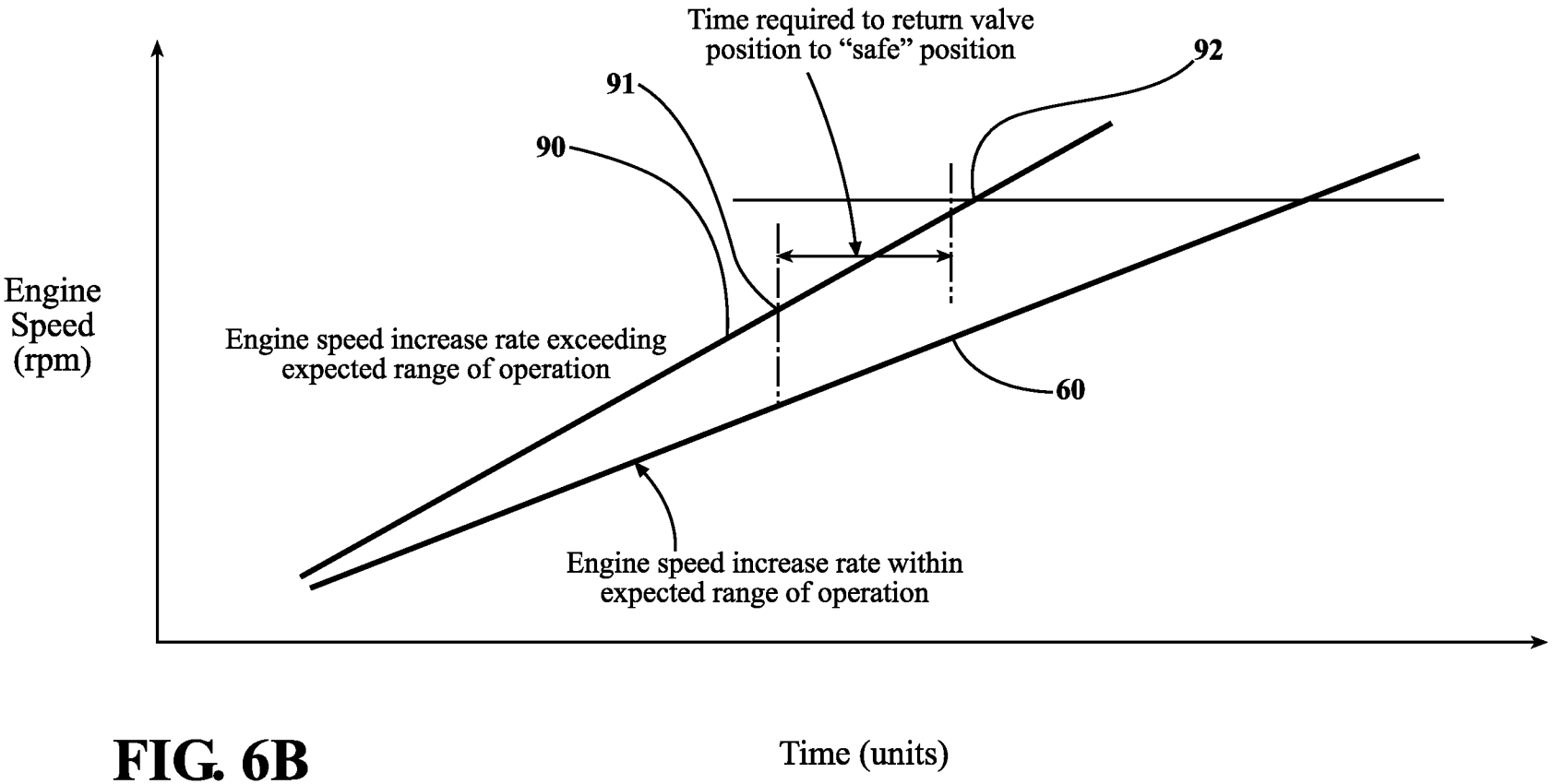
FIG. 6B is a graph depicting engine speed and time where the engine speed increase rate exceeds expected range of operations and depicting another aspect of a valve operation control method and apparatus.

FIG. 6B depicts a similar engine speed versus time graph. In FIG. 6B, a separate graph line 90 is shown to represent an engine speed increase rate or acceleration exceeding an expected engine range of operation. The data represented by this graph line is calibrated for each particular engine type, but generally indicates an over-speed or over-rev condition. Prior to reaching an engine speed at which valve surge is likely to occur, as denoted by engine speed 92, the ECU 31, as shown in FIG. 7B, executes a stored program utilizing the valve surge look-up table stored in memory to initiate repositioning of the valve to a safe state taking into account the time to return the valve position, either lift and/or timing, to the safe position and upon the then current valve timing, lift position, valve operating angle etc.

Figure 7B:
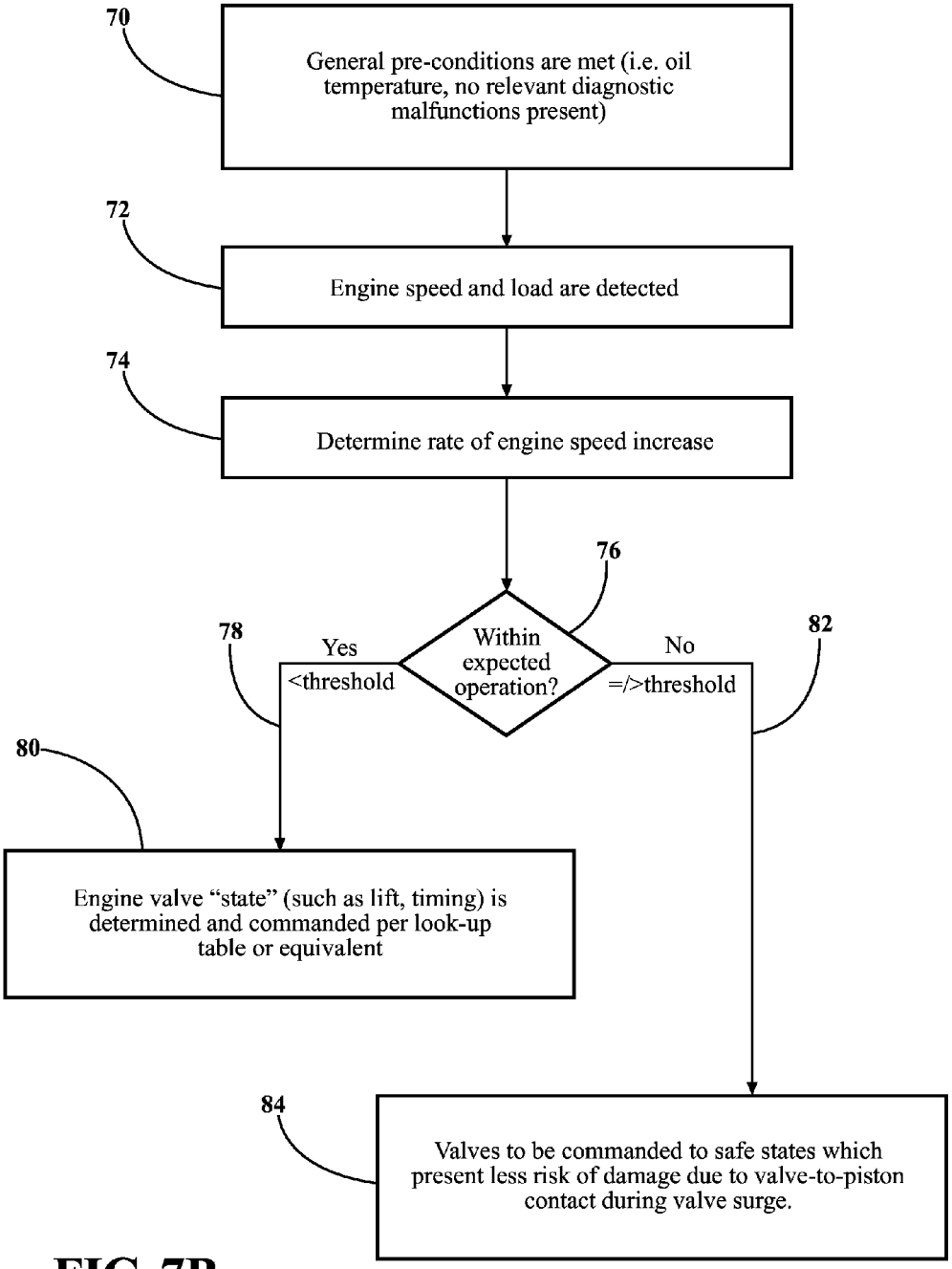
FIG. 7B is a flow chart depicting the sequence control steps for implementing the aspect of the valve operating control method and apparatus depicted in FIG. 6B.

Referring now to FIG. 7B, the ECU 31 executes the same steps in conjunction with the logic detection shown in FIG. 7B as it did with the general speed increase shown in FIG. 6A and 7A by determining the engine preconditions on map in step 70. Engine speed and engine load and then detected in step 72. The rate of engine speed increase or acceleration is determined in step 74 and compared with calibratible values for the particular engine in step 76. If the rate of engine speed increase is within expected front engine parameters as shown by step 78, the ECU 31 determines the engine valve state, such as valve lift, timing, etc. in step 80 and commands the valve, further look-up table or equivalent to the particular valve position. For example, higher engine speeds are associated with higher lifts for intake and exhaust valves and latest or most retarded closing time.

Alternately, if the comparison in step 76 yields a determination that the determined rate of engine speed increase in steps 76 is not within an expected range of engine operations and exceeds a calibratible threshold as shown by step 82, the ECU 31 issues commands to reposition the control shaft 26 to move the intake valves 22 and 24 to the safe state, as described above, which, in step 84, presents less risk of damage from valve to piston contact during the valve surge.

The graphical values along the graph line 90 in the graph depicted in FIG. 6B represent engine speed increase rates or acceleration exceeding an expected range of operation of the vehicle engine. When the engine speed increase rate, is calculated by the ECU from the engine speed and other factors approaches or reaches an engine speed corresponding to the graphical point 91, the ECU, using the separate look-up table from that employed with the normal expected range of engine acceleration shown in FIG. 6A, will move the intake valves 22 and 24 to the safe position as described above.

It should be noted that the graphical point 91 on the graph in FIG. 6B is earlier in time than the similar point 64 on the graph line 60 in FIG. 6A. This time difference takes into account the increased acceleration rate depicted by the graph in line 90 in FIG. 6B which requires an earlier start to begin movement of the intake valves 22 and 24 to a safe position since the engine is accelerating at a higher rate toward the engine speed 92 at which valve surge is likely to occur and there is less time before the engine reaches the preset speed 92.

Since the time required to return the intake valves 22 and 24 to the safe position is about the same in each engine operating condition shown by the graphs in FIGS. 6A and 6B, the ECU, using the values in the different look-up tables, must begin to move the intake valves 22 and 24 towards the safe position at an earlier point in the acceleration line since, in the engine operating condition depicted by FIG. 6B, the engine is accelerating at a rate exceeding expected engine range of operation and therefore is likely to reach engine speed at which valve surge is likely to occur in a shorter amount of time than when the engine speed increase rate is within the expected range of operation as shown in FIG. 6A.

What is claimed is:

1. An internal combustion engine valve operation control apparatus comprising:

at least one of an intake valve and an exhaust valve movably disposed with respect to an engine cylinder to open and close a port in an engine combustion chamber in a timed relationship to a position of a piston reciprocally mounted in the engine combustion chamber;

an intake and an exhaust valve movement actuator coupled to the at least one of the intake valve and the exhaust valve to control movement of the at least one of the intake valve and the exhaust valve between port closed and port open positions in response to changes in engine operating parameters; and a control, receiving engine speed signals from the engine and configured to anticipate a valve surge, the control controlling the intake and exhaust valve movement actuator to move the at least one of the intake valve and the exhaust valve to a safe state with respect to the piston in the engine cylinder when at least one of a rate of increase in engine speed exceeds a threshold rate of increase of engine speed, and engine speed exceeds a threshold engine speed to prevent contact between the at least one of the intake valve and the exhaust valve and the piston.

2. The apparatus of claim 1 wherein:

the intake and exhaust valve movement actuator variably positions the at least one of the intake valve and the exhaust valve in one of a low lift position where the at least one of the intake valve and the exhaust valve extends a small distance into the engine combustion chamber at a valve open position at a first engine operating state and a high lift position where the at least one of the intake valve and the exhaust valve extends a greater distance into the engine combustion chamber during a second engine operating state.

3. The apparatus of claim 2 wherein:

the control controls the intake and exhaust valve movement actuator to move the at least one of the intake valve and the exhaust valve to the safe state as an engine operating condition performance moves from the first engine operating state toward the second engine operating state.

4. The apparatus of claim 2 wherein:

the control is responsive to at least one of a rate of change of engine speed and an increase of engine speed moving from the first engine operating state toward the second engine operating state.

5. The apparatus of claim 1 wherein:

the control executes a stored program of at least one of speed and rate of speed increase and setting a threshold of at least one of engine speed and rate of increase of engine speed associated with contact of the at least one intake and exhaust valve with the piston.

6. The apparatus of claim 5 wherein:

the engine operating condition is engine speed.

7. The apparatus of claim 6 wherein:

the threshold is a predetermined engine speed.

8. The apparatus of claim 5 wherein:

the engine operating condition is engine speed; and the threshold is a predetermined rate of increase in engine speed.

9. The apparatus of claim 8 wherein:

a calibratible engine speed is determined, for predetermined rate of increase in engine speed, that corresponds to a likelihood of contact between the at least one of the intake valve and the exhaust valve with the piston;

the control, in response to the engine speed reaching the calibratible engine speed, controlling the intake and exhaust valve movement actuator to move the at least one of the intake valve and the exhaust valve to a safe position.

10. The apparatus of claim 5 wherein:

the engine operating condition is a predetermined acceleration rate of the engine speed above an expected acceleration rate of engine operation.

11. The apparatus of claim 1 wherein:

the control moves the at least one of the intake valve and the exhaust valve to a safe position defined by movement of the valve from a high lift state toward a low lift state.

12. The apparatus of claim 1 wherein:

the control, in response to engine operating conditions, moves the at least one of the intake valve and the exhaust valve to the safe state by reducing a preset valve open time duration.

13. A method of controlling a position of at least one of an intake valve and an exhaust valve in one combustion chamber of an internal combustion engine with respect to piston position in the combustion chamber based on engine operating conditions, the method comprising:

sensing a current value of one at least one of engine speed and a rate of increase of engine speed;

comparing the current value of the at least one of engine speed and a rate of increase of engine speed with prestored values of the at least one valve position with respect to a position of a piston in the combustion chamber;

establishing a threshold value of the at least one of engine speed and the rate of increase of engine speed above which a threshold increases a possibility of contact between the at least one of the intake valve and exhaust valve with the piston; and anticipating a valve surge occurrence when the threshold value is met or exceeded, and moving the at least one of the intake valve and the exhaust valve to a safe position to prevent potential contact with the piston.

14. The method of claim 13 further comprising:

establishing the threshold value and a predetermined rate of change of at least one engine operating condition with respect to the at least one of the intake valve and the exhaust valve engine cycle positions.

15. The method of claim 14 wherein the engine operating condition is engine speed.

16. The method of claim 14 further comprising:

moving the at least one of the intake valve and the exhaust valve between a low lift position and a high lift position depending upon the at least one engine operating condition.

17. The method of claim 16 further comprising:

moving the at least one of the intake valve and the exhaust valve from the high lift position toward the low lift position.

18. The method of claim 13 further comprising:

moving the at least one of the intake valve and the exhaust valve to a safe position by varying the valve timing.

* * * * *